United States Patent [19]

Giulie

[11] 3,972,085

[45] Aug. 3, 1976

[54] CUT-OFF DEVICE FOR BINDING MACHINE

[75] Inventor: Joe D. Giulie, Palo Alto, Calif.

[73] Assignee: Minnesota Mining and Manufacturing Company, St. Paul, Minn.

[22] Filed: June 2, 1975

[21] Appl. No.: 582,812

Related U.S. Application Data

[63] Continuation of Ser. No. 511,172, Oct. 2, 1974, abandoned.

[52] U.S. Cl. ..... 11/1 MB; 281/21 R; 83/620; 83/694

[51] Int. Cl.[2] ..... B42C 19/00; B26D 5/08; B26D 1/00

[58] Field of Search ..... 11/1 R; 281/21; 83/620, 83/694

[56] References Cited

UNITED STATES PATENTS

| | | | |
|---|---|---|---|
| 1,744,923 | 1/1930 | Roe | 11/1 MB |
| 3,608,117 | 9/1971 | Abildgaard et al. | 11/1 R |
| 3,811,146 | 5/1974 | Abildgaard et al. | 11/1 R |

*Primary Examiner*—Lawrence Charles
*Attorney, Agent, or Firm*—Alexander, Sell, Steldt & DeLaHunt

[57] ABSTRACT

In a binding machine wherein mechanical binding elements are first placed through a sheaf of papers and the surplus lengths of the studs of the binding element are cut off, an improved knife is provided wherein the knife is in the form of one or more U-shaped segments. In a preferred embodiment of the invention, the arms of the U which at least partially support the binding elements also serve to move locking blocks into place. The blade element is at the bight of the U and the blade is slid along the back of the female binding element to cut off excess stud lengths flush with the binding element.

6 Claims, 7 Drawing Figures

CUT-OFF DEVICE FOR BINDING MACHINE

This is a continuation of application Ser. No. 511,172 filed Oct. 2, 1974, now abandoned.

BACKGROUND OF THE INVENTION a. Field of the Invention

This invention relates to an improvement in the cut-off device for binding machines of the type wherein a sheaf of papers is compressed between a male spine having a series of studs which extend from the spine, through perforations in a sheaf of paper, and then into a mating female spine; the female spine must be supported at spaced intervals and the excess stud length cut off. In a preferred embodiment of the invention, the cut-off device is utilized with binding elements wherein the studs have ratchet teeth and the female spine has a mating tooth with a blocking element which moves into place behind the stud to hold the ratchet teeth in engagement.

b. Description of the Prior Art

The closest known prior art is U.S. Pat. No. 3,608,117 wherein a heated cut-off device is used to sever an excess spine length in a binding machine. In said patent, a heated knife severs the excess stud length some distance from a female binding element whereby there is left a short, heat-softened stub which can be swaged into a rivet head in a subsequent operation. The knife element does not support the female spine and an independent means of support must be employed. The present invention differs from this prior art patent primarily in that (a) the knife of the present invention provides at least partial support for the female binding element while the parts are in compressed condition, (b) the knife of the present invention severs the excess spine flush with the female binding element, and (c) the knife of the present invention is not heated.

SUMMARY OF THE INVENTION

Co-pending patent application Ser. No. 441,378 filed Feb. 11, 1974 describes and claims a machine for binding a sheaf of papers. This machine utilizes as a binding element a male spine having a series of studs extending therefrom each with ratchet teeth and a mating female spine with a single ratchet tooth in each opening. A movable block is provided for locking the ratchet teeth together. To utilize the binding system, the male element is inserted through pre-formed holes in a sheaf of paper and into the female element. The spines are then compressed toward each other to a desired extent whereupon the ratchet teeth on the male and female elements engage each other and when a desired degree of compression is achieved, the blocking element is pushed into place, holding the teeth in engagement. The surplus lengths of the studs are then cut off, leaving the bound sheaf of paper.

In the above-identified patent application, the female binding element was first supported on a series of spaced fingers to secure the initial compression and intermeshing fingers which were located on a lower plane were utilized to push the blocking elements into place. After the blocking elements were in place, a thin knife blade was then forced under the female spine to cut off the excess stud length. It was necessary that this knife be forced between the support for the blocking elements and the binding strip itself against the action of a ram and so a substantial amount of force was required to move the knife between the support member and the binding strip, and frequently this cut into the lower edge of the binding strip and also increased the pressure on the stack of papers being bound.

In accordance with the present invention, a cut-off device is provided which includes both a support for the binding strip which pushes the blocks into place and also serves as a blade for cutting off the excess stud lengths. This is accomplished by providing a U-shaped knife wherein the arms of the U support the binding strip and push the blocking means into place and wherein the center portion of the U is sharpened. With such a knife, it is only necessary to move the assembly in a horizontal direction so that no additional space is required, causing force to be exerted in a vertical direction against the binding elements or the stack of paper. Thus, the pressure on a stack of paper is not increased nor is there any danger of cutting into the lower binding element.

Although it is preferred to use the cut-off device with such ratchet locked binding elements, it can be employed in any binding operation wherein a female spine is supported at spaced intervals and an excess stud length cut off.

DESCRIPTION OF THE PREFERRED EMBODIMENT

Figure 1:
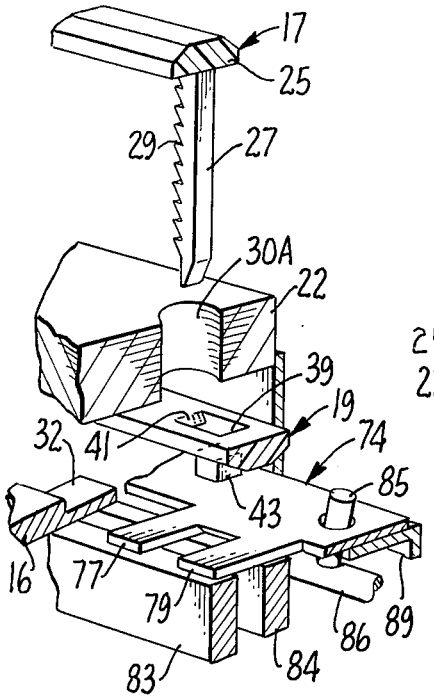
FIG. 1 is an exploded perspective view, partly in section, of a portion of a binding machine showing the elements in place as a binding operation is about to begin.

Referring now to the drawings by reference characters, there is shown an upper binding element generally designated 17 and a lower binding element generally designated 19. The upper binding element, or male element, has a spine 25 with a plurality of studs 27 extending therefrom, each of which has a plurality of ratchet teeth 29. The lower, or female binding element 19, comprises a spine with a series of apertures 39 therein, each of which has at least one ratchet tooth extending into the aperture from the wall thereof. The tooth 41 is adapted to mate with one of the ratchet teeth 29 as the spines are pressed together. A block 43 carried on element 19 adjacent each aperture 39 is adapted to be wedged into the aperture 39 behind stud 27 to lock the teeth into place. After the teeth are locked into place, the extra length of stud extending beyond the female element 19 is cut off. While the papers are being compressed, it is important that no pressure be placed on the block 43 so that the lower binding element is initially supported on a series of spaced fingers 32 which extend from table 16 and which is mounted on a preloaded spring support so that a substantial amount of pressure can be placed on the table before it moves downwardly. After the papers are sufficiently compressed to overcome the preload on table 16, the table and fingers 32 move downwardly which allows the blocks to come into contact with an element which moves the blocks into place and subsequently cuts off the excess stud length. It is this combined means for pressing the blocks into place while at least partially supporting the female spine and cutting the studs off to the desired length which constitutes the present invention and this device will now be described in detail.

The cut-off assembly, generally designated 74 which constitutes the gist of the present invention provides means for defining a plurality of blades or U-shaped members. The cut-off assembly 74 includes a back member 75 with two arms 77 and 79 extending therefrom. At the bight portion of the U formed by the arms 77 and 79 is formed a knife blade 81. As can best be seen in FIG. 6, the blade is formed by an undercut starting on the top surface so that the actual cutting edge is on the top plane and the top surface of the blade is flat. The arms are mounted in sliding relationship on the frame members 83 and 84 which are placed a sufficient distance apart to allow the free passage of a stud therebetween. The assembly 74 is thus supported firmly against vertical movement but is free to slide horizontally and means are provided for moving the assembly horizontally such as the shaft 86 carrying pins 85 which fit into holes 87 of assembly 74.

Figure 2:
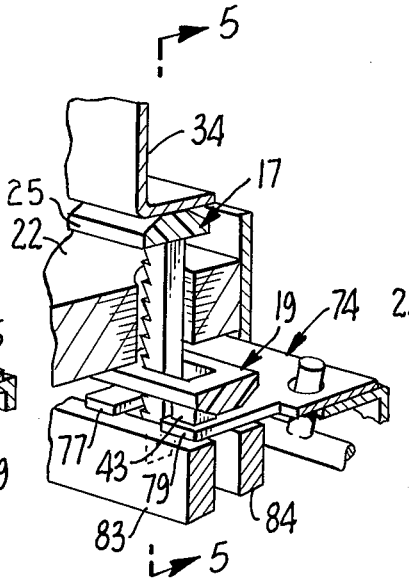
FIG. 2 is a perspective view similar to FIG. 1 showing the position of the parts wherein the initial binding operation is about to begin.
Figure 3:
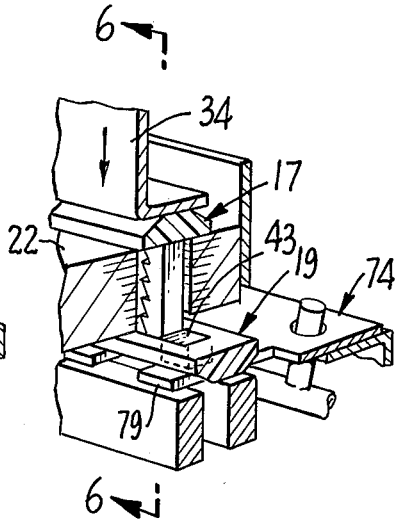
FIG. 3 is a view showing the binding operation but prior to the cut-off action.
Figure 5:
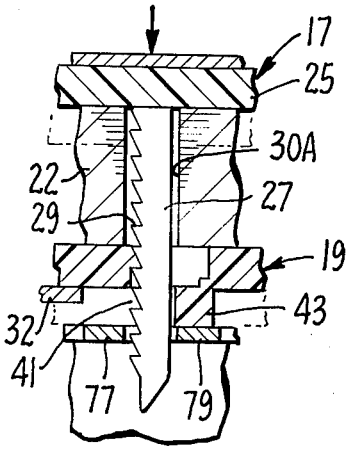
FIG. 5 is a sectional view taken along the line 5—5 of FIG. 2 but shown with the binding elements fully engaged.

The overall operation can now be seen. In FIG. 1 the parts are shown in an exploded view just as the assembly operation begins. A sheaf of papers 22 having a series of perforations 30A is placed over the lower binding element 19 and the studs of the upper binding element pass down through the paper and into the lower binding element while the lower binding element is supported on a first plane defined by support surfaces on the fingers 32 as is shown in FIGS. 1 and 5. The lower binding element has the blocks 43 attached thereto but these blocks are not in contact with the arms 77 and 79. Thus, at this point the relationship of the parts is as shown in FIGS. 2 and 5. Now, ram 34 is brought down and this first compresses the spines together with the sheaf of papers therebetween until the support for table 16 is overcome. At this point, the table 16 and fingers 32 move downwardly so that the support surfaces on the fingers move toward a second plane defined by a planar surface on the cut-off assembly 74 and the blocks 43 are brought into contact with the portion of said second plane defined by one of the arms 77 or 79. Thus, the blocks start to move into place and as pressure continues, the female binding element will be supported on both the fingers 32 and the arms 77 and 79, the surfaces of which now both lie on the same plane. At this point, the blocks are fully in place and the parts are as shown in solid lines in FIGS. 3 and 6. The knife actuating means now moves the assembly 74 in a horizontal plane as is shown by the arrow in FIG. 6 so that the knife moves from a first position shown in solid lines in FIG. 6 a second position shown in dot/dash lines. This cuts off the excess stud length and it falls free at 87. The cut-off blade, as shown, cannot cut into the lower element and the cut-off is always flush with the surface of the female spine, giving a smooth finished surface. This completes the binding operation and the knife assembly 74 is retracted as well as the ram 34 and the finished bound volume can now be removed from the machine.

In the above description, it has been assumed that all of the studs of a binding strip would be locked and cut at the same time. In some simpler machines, a single stud is locked and cut at a time, in which case the device of the present invention would include only a single knife 81 and arms 77 and 79 rather than a plurality as is shown in FIG. 7.

Figure 7:
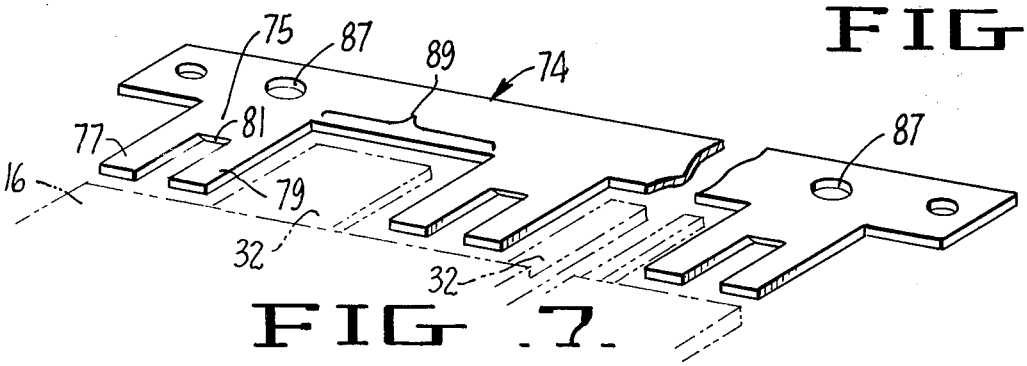
FIG. 7 is a perspective view of a knife assembly embodying the present invention having a plurality of blades and arms thereon.

As is shown in FIG. 7, in a multiple post machine, there will be a plurality of pairs of arms 77 and 79, each with a knife edge 81 between them. The pairs are spaced so that the distance 89 between adjacent pairs gives clearance to the fingers 32 of table 16 as is shown in phantom in FIG. 7.

Although it is preferred to use the machine with blocking elements or the female spine, the machine can be used in any binding operation wherein an excess stud length is to be cut off.

I claim:

1. In a machine adapted to press together first and second binding elements to bind a stack of sheet material having spaced openings along one edge, the first binding element having a plurality of projecting studs adapted to project through the openings in the stack and the second binding element having a plurality of spaced holes adapted to receive the studs, said machine comprising a plurality of spaced fingers having support surfaces aligned to define a plane adapted for supporting a said second binding element, means adapted for pressing a said first binding element toward a said second binding element supported on said fingers to compress a said stack of sheet material therebetween and push the studs through the mating holes in the second binding element, means adapted for locking the engaged binding elements together, and means adapted for cutting off the end portions of the studs extending through the holes past the second binding element, the improvement wherein said means adapted for cutting comprises:

means for defining a plurality of generally U-shaped members each having spaced arms with corresponding side surfaces of said arms defining a planar surface and having a sharp edge on the bight portion thereof between the adjacent edges of said arms, each of said U-shaped members being adapted to be positioned with its arms along opposite sides of one of the holes of a said second binding element and with said planar surface contacting the second binding element;

means for mounting said U-shaped members in spaced alignment for movement from (1) a first position adapted so that the planar surfaces on the arms are aligned to define a plane and can at least partially support a said second binding element and permit the studs of a said first binding element to pass through the second binding element and between the spaced arms of said U-shaped members when the binding elements are compressed by said means for compressing, (2) toward a second position with said planar surfaces remaining in the plane defined thereby so that the sharp edges of said U-shaped members will cut off the ends of the studs projecting past the second binding element during such movement; and means for moving the U-shaped members from their first position to their second position.

2. A machine according to claim 1 further including means mounting said fingers for movement from a first position with the plane defined by the support surfaces of said fingers spaced from the plane defined by the planar surfaces of said fingers, to a second position with said planes in alignment, said fingers being spaced to afford clearance for said arms upon movement of said fingers to said second position; and means for moving said fingers from said first to said second position during activation of said means adapted for pressing a said first binding element supported on said fingers to compress a said stack of sheet material therebetween so that in the second position of said fingers the second binding element is supported on both said fingers and said arms.

3. A machine according to claim 2 adapted for use with a said second binding element having locking blocks adjacent to each of the holes, which blocks are adapted to be pushed into the holes to grip studs therein, wherein the spacing of said fingers is adapted so that there is no contact with the blocks of a said second binding element supported thereon and the arms of said U-shaped members are adapted to engage said blocks and push them into place when said fingers are moved to their second position by the operation of said means adapted for pressing to provide said means adapted for locking together the engaged binding elements.

4. A machine according to claim 1 wherein the sharp edge of each of said U-shaped members is provided by a beveled edge surface forming an acute angle with the planar surface thereof.

5. In a machine adapted to press together first and second binding elements to bind a stack of sheet material having spaced openings along one edge, the first binding element having a plurality of projecting studs adapted to project through the openings in the stack and the second binding element having a plurality of spaced holes adapted to receive the studs, said machine comprising a plurality of spaced fingers having support surfaces adapted for supporting a said second binding element, means mounting said fingers for movement between a first position with said support surfaces in a first plane to a second position with said support surfaces in a second plane, pressing means adapted for pressing a said first binding element toward a said second binding element supported on said fingers to compress a said stack of sheet material therebetween and push the studs of the first binding element through the mating holes in the second binding element, means for moving said fingers from said first position to said second position during activation of said pressing means, means adapted for locking the engaged binding elements together upon movement of said fingers to said second position and means adapted for cutting off the end portions of the studs extending through the holes past a said second binding element upon movement of said fingers to said second position, the improvement wherein said means adapted for cutting comprises:

means for defining a plurality of blades each having a planar surface, a sharp edge on said planar surface and at least one arm-like portion defining a portion of said planar surface and projecting past an end of said sharp edge;

means for mounting said blades in spaced alignment for movement from (1) a first position in which the planar surfaces on said arm-like portions are in said second plane, said projecting arm-like portions are generally parallel and the positions thereof are adapted so that a said second binding element will contact the portions of said planar surfaces on said arm-like portions when said fingers are moved to said second position during the operation of said pressing means with each of the studs of a said first binding element passing through the second binding element closely adjacent the arm and sharp edge of one of said blades, (2) toward a second position adapted so that said sharp edges of said blades will cut off the ends of studs projecting past a said second binding element when said pressing means are activated and said fingers are moved toward said second position; and means for moving said blades from their first to their second position thereof.

6. A machine according to claim 5 adapted for use with a said second binding element having locking blocks adjacent to each of the holes, which blocks are adapted to be pushed into the holes to grip studs therein, wherein the spacing of said fingers is adapted so that there is no contact with the blocks of a said second binding element supported thereon and the arm-like portions of said blades are adapted to engage said blocks and push them into place while said fingers are being moved to their second position by the operation of said pressing means.

7. A machine according to claim 5 wherein each of said blades has a second arm projecting from the end of said sharp edge opposite said first mentioned arm to provide a generally U-shaped blade, both of said arms on each blade provide a portion of said planar surface, and said arms on each blade are adapted to be positioned on opposite sides of one of the holes of a said second binding element positioned in said machine.

* * * * *

UNITED STATES PATENT AND TRADEMARK OFFICE

CERTIFICATE OF CORRECTION

PATENT NO. : 3,972,085

DATED : August 3, 1976

INVENTOR(S) : Joe D. Giulie

Figure 6:
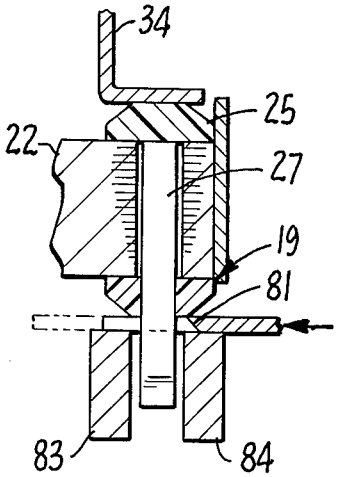
FIG. 6 is a sectional view taken along the line 6—6 of FIG. 3.
Figure 4:
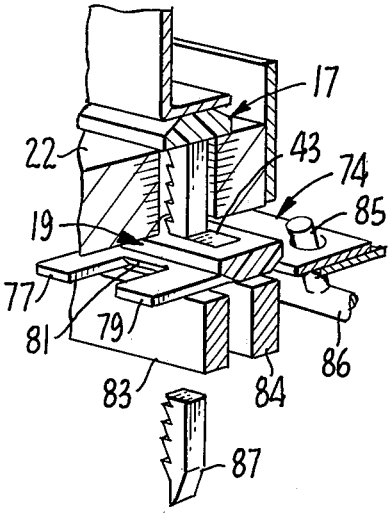
FIG. 4 is a perspective view showing the horizontal movement of the knife of the present invention and the completion of the cut-off action.

It is certified that error appears in the above-identified patent and that said Letters Patent are hereby corrected as shown below:

Column 3, line 61, after "FIG. 6" insert -- to --.

Column 4, line 14, change "or" to -- on --.

In the Claims

Column 4, line 68, change "fingers" to -- arms --.

Column 5, line 10, delete "locking".

Column 6, line 28, change "position thereof" to -- positions --; and delete claim 7.

Signed and Sealed this

Twenty-first Day of December 1976

[SEAL]

*Attest:*

RUTH C. MASON
*Attesting Officer*

C. MARSHALL DANN
*Commissioner of Patents and Trademarks*